US011441270B2

(12) United States Patent
Eckerstorfer et al.

(10) Patent No.: US 11,441,270 B2
(45) Date of Patent: Sep. 13, 2022

(54) SUCTION ROLL

(71) Applicant: Röchling Industrial Oepping GmbH & Co. KG, Oepping (AT)

(72) Inventors: Peter Eckerstorfer, Ulrichsberg (AT); Anton Luger, Sarleinsbach (AT); Markus Ecker, Oepping (AT)

(73) Assignee: RÖCHLING INDUSTRIAL OEPPING GMBH & CO. KG, Oepping (AT)

( * ) Notice: Subject to any disclaimer, the term of this patent is extended or adjusted under 35 U.S.C. 154(b) by 0 days.

(21) Appl. No.: 17/125,149

(22) Filed: Dec. 17, 2020

(65) Prior Publication Data

US 2021/0189653 A1 Jun. 24, 2021

(30) Foreign Application Priority Data

Dec. 19, 2019 (AU) ..... A 51135/2019

(51) Int. Cl.

| | |
|---|---|
| ***D21G 9/00*** | (2006.01) |
| ***D21F 3/06*** | (2006.01) |
| ***D21F 3/10*** | (2006.01) |

(52) U.S. Cl.

CPC ..... *D21G 9/0036* (2013.01); *D21F 3/06* (2013.01); *D21F 3/10* (2013.01)

(58) Field of Classification Search

CPC ..... D21G 9/0036; D21F 3/06; D21F 3/10; D21F 1/48; F26B 13/00

See application file for complete search history.

(56) References Cited

U.S. PATENT DOCUMENTS

| | | | | |
|---|---|---|---|---|
| 2014/0070495 | A1* | 3/2014 | Schotge | F16J 15/16 277/345 |
| 2017/0254019 | A1* | 9/2017 | Keinberger | D21F 3/02 |
| 2017/0254020 | A1 | 9/2017 | Keinberger et al. | |

FOREIGN PATENT DOCUMENTS

| | | | |
|---|---|---|---|
| EP | 0990865 | A2 | 4/2000 |
| EP | 102004059028 | A1 | 6/2006 |

OTHER PUBLICATIONS

Austrian Search Report in Austria Application No. A 51135/2019, dated May 5, 2020, 1 page.

* cited by examiner

*Primary Examiner* — Eric Hug
*Assistant Examiner* — Matthew M Eslami
(74) *Attorney, Agent, or Firm* — Liang & Hennessey LLP; Brian Hennessey

(57) ABSTRACT

The invention relates to suction roll, which has in the space within its roll sleeve at least one transmitter, from which transmitter data is wirelessly transmitted to a receiver, which is also present in the space within the roll sleeve, and wherein the suction roll has at least one additional component to transfer data out of and/or into the suction roll.

6 Claims, 3 Drawing Sheets

SUCTION ROLL

CROSS-REFERENCE TO RELATED APPLICATIONS

The present application claims the benefit of Austrian Patent Application No. A 51135/2017, filed Dec. 19, 2019, entitled "SUCTION ROLL", which is incorporated by reference in its entirety.

BACKGROUND OF THE INVENTION

1. Field of the Invention

The present invention relates to a suction roll, which is employed in dewatering web material, such as in papermaking machines.

2. Description of the Related Art

DE102004059028A1 discloses a sealing strip system with a wear indicator.

EP0990865A2 relates to a measurement system for determining the moisture content of a fibrous web, wherein a transmitter and receiver form a sensor, wherein the receiver receives light or radiation of the transmitter. The transmitter transfers to the receiver not data, but auxiliary energy which is applied as a measurement signal at the input of the receiver after passing the material web (or after reflection at the material web). The auxiliary energy of the transmitter as such does not contain data. A measurement value is present only at the output of the receiver.

It is known, for example, from US2017254019 (A1) and US2017254020 (A1), both by the applicant, to arrange inside the suction roll temperature sensors, which are arranged on a printed circuit board alongside a battery and a microchip. The microchip is provided with a radio module, so that it can transmit data to a mini server provided externally to the suction roll. It has been found disadvantageous that the direct radio communication from the radio module to the mini server may be subject to signal interference.

SUMMARY OF THE INVENTION

A suction roll, which is employed in dewatering web material such as in papermaking machines, has a metallic roll sleeve provided with openings and at least one suction box on the inside. The suction box is non-displaceably mounted inside the suction roll, while the roll sleeve provided with holes rotates around the suction box. In order to seal off the suction box against the roll sleeve, it has on its sides sealing strips which seal off the inside of the suction box against the rest of the volume of the suction roll in a longitudinal direction of the suction roll. In a circumferential direction of the suction roll, the suction box is delimited on both its ends, and sealed off against the roll sleeve, by edge deckles.

Inside the suction roll, sensors and actuators may be present, which are connected to a control unit arranged externally to the suction roll and which are to be supplied with electrical energy.

It is the object of the present invention to improve the data exchange between sensors and/or actuators and a device, in particular a control unit, placed externally to the suction roll.

Proposed as an improvement according to the invention is a suction roll, which has in the space within its roll sleeve at least one transmitter, from which transmitter data is wirelessly transmitted to a receiver, which is also present in the space within the roll sleeve, and wherein the suction roll additionally has means (in the form of one or more additional components) to transfer data out of and/or into the suction roll.

The space within the roll sleeve is to be understood as the space which is enclosed by the inner sleeve area of the roll sleeve. The roll sleeve itself, and in particular sensors and/or transmitters and/or receivers in the roll sleeve, are not present in the space and are therefore not included in the present invention, i.e. excluded from this definition.

The means or components may be leads, for example electrical or optical for wired or leaded data transfer, or means or components for wireless data transfer. Transmitters, receivers, transceivers, electrical conductors, cables, fibre optics, bushings, plugs, routers, multiplexers, demultiplexers and other members and equipment typically used in data transfer may find use as means or components.

Data communication between the electronic members within the suction roll and a device arranged externally to the suction roll, in particular a data processing system, a server, a user equipment, or a control unit for the suction roll, may be established via the means or component.

Preferably, the suction roll comprises at least one sensor, wherein data of the sensor are transmitted from the transmitter to the receiver and the additional means or component transfers data from the receiver out of the suction roll. The data may originate directly with the receiver or be already processed or edited in the suction roll.

Preferably, the suction roll comprises at least one actuator, wherein the additional means or component transfers data into the suction roll, and wherein the data is transmitted from the transmitter to the receiver, which is in data communication with the actuator. The data may reach the transmitter directly from the additional means or component or be previously processed or edited in the suction roll.

Preferably, the suction roll has within the roll sleeve at least two transceivers wirelessly communicating with each other, one of which is in data communication with a device external to the suction roll and the other of which is in data communication with at least one sensor and/or actuator via the additional means or component.

In particular, proposed is a suction roll, which has in the space within its roll sleeve at least one transmitter, from which transmitter data is wirelessly transmitted to a receiver, which is also present in the space within the roll sleeve, and wherein the receiver or the transmitter is in data communication with a control unit arranged externally to the suction roll.

Preferably, the suction roll comprises at least one sensor, wherein data of the sensor are transmitted from the transmitter to the receiver and the receiver is in data communication with the control unit.

Preferably, the suction roll comprises at least one actuator, wherein data of the control unit is transmitted from the transmitter to the receiver and the transmitter is in data communication with the control unit.

Preferably, at least on sensor is selected from the group of sensors comprising: temperature sensor, wear sensor, distance sensor, flow sensor, vibration sensor, sound sensor, deformation sensor, position sensor. The sensor may also be an optical sensor, for example in the form of a camera.

Preferably, the suction roll has in the space within the roll sleeve at least two transceivers wirelessly communicating with each other, one of which is in data communication with the control unit and the other of which is in data communication with at least one sensor and/or actuator.

Preferably, contactless electrical energy transfer takes place from at least one transmitter and/or receiver which is in data communication with the control unit to a transmitter and/or receiver which is in data communication at least with a sensor or actuator.

Preferably, the electrical energy supply to at least one sensor, actuator or to an energy storage associated therewith takes place by energy transferred in a contactless manner.

Preferably, an element transferring electrical energy in a contactless manner is arranged on or in the sealing strip holder of the suction roll. Preferably, an element receiving this energy in a contactless manner which supplies electrical energy to a sensor or actuator or to an energy storage is arranged in a further element selected from: an element of the lubricating water system; an element of the engagement system; or the sealing strip.

Preferably, a receiver is arranged on or in the sealing strip holder of the suction roll. Preferably, a transmitter, which transmits sensor data to the receiver, is arranged in a further element selected from: an element of the lubricating water system; an element of the engagement system; the sealing strip holder itself; or the sealing strip.

A device in which the transfer system according to the invention can be used consists of a suction roll, inside of which a suction box delimited on its sides by sealing strips is disposed. Each sealing strip is preferably associated with a lubricating water feed, which introduces lubricant in the direction of the inside of the holed sleeve of the suction roll upstream of the sealing strip in running direction. Each sealing strip preferably has at least one actuator, via which the engagement pressure of the sealing strip on the inner sleeve area of the suction roll can be modified. The second, rear sealing strip in running direction preferably has additionally a second actuator, via which the aperture angle of the gap between the sealing strip and the suction roll sleeve can be modified. The second, rear sealing strip in running direction preferably has an electroacoustic transducer, which is preferably integrated into the holder of the sealing strip and therefore protected against humidity. It is preferably provided to process the data of the sensors in a control unit, preferably a mini server or PLC (programmable logic controller), and to control the actuators via the control unit, in particular the mini server or PLC. A mini server is a miniaturised data processing system with input and output modules and possibilities for digital communication, in particular wireless communication, with input and output equipment and other data processing systems of a network. An PLC may also serve as a control unit.

Preferably, the temperature of the sealing strip is measured. Preferably, the employment or amount of lubricating water is controlled or regulated as a function of the temperature measured. In addition, the temperature may be measured at one or more points of the sealing strip.

Each sealing strip may be associated with a spray pipe, which may be integrated into the sealing strip holder.

A flow sensor, which may be in data communication with the mini server to monitor the amount of spray water employed in real time, may be present in the spray pipe or in the lead leading to the spray pipe. The flow amount is regulated or controlled by the mini server, for example by adjusting a valve.

A regulating method combining all subareas may comprise: measuring the temperature in the sealing strips, measuring the vacuum in the suction box, measuring the sound level downstream of the second sealing strip, regulating the engagement pressure of the sealing strips, regulating the amount of lubricating water, and regulating the aperture angle of the second sealing strip.

In a variant embodiment, at least one camera is provided in the space within the roll sleeve of the suction roll.

One or more cameras may be disposed upstream of, downstream of, or in the suction box. The cameras are preferably each oriented towards the roll sleeve, in particular the roll sleeve and a sealing strip. The cameras may be used, for example, to detect the dewatering distribution, streams, fault conditions and/or clogging of the perforations in the roll sleeve. Preferably, data, in particular visual recordings, of at least one camera are transferred within the suction roll wirelessly, in particular per radio from a transmitter to a receiver. Preferably, at least one camera has a wireless, in particular radio, transmitter.

Preferably, the suction roll has controlled or regulated edge deckles. Preferably, at least one edge deckle of the suction roll comprises a sensor or measurement assembly for measuring distances and/or positions.

In a variant embodiment, the distance of the edge deckle from the roll sleeve is measured.

In a variant embodiment, the position of the edge deckle in a longitudinal direction of the suction roll is determined.

Preferably, the data of the distance and/or position measurement are transferred wirelessly from a transmitter to a receiver within the suction roll.

Preferably, at least one edge deckle has at least one actuator for position adjustment.

In a variant embodiment, the distance of the edge deckle from the roll sleeve is adjusted.

In a variant embodiment, the position of the edge deckle is adjusted in a longitudinal direction of the suction roll.

Preferably, the control and/or regulating commands are conveyed to the actuator for distance and/or position adjustment or regulation wirelessly from a transmitter to a receiver within the suction roll.

Preferably, the communication is digital.

The suction roll preferably has adjustable edge deckles. Edge deckles are sealing elements which have an arcuate course of their sealing area and therewith adjoin the inner sleeve area of the roll sleeve in a circumferential direction. The edge deckles therefore seal off the zone between two sealing strips in a circumferential direction of the roll sleeve.

Preferably, at least one edge deckle is present between the sealing strips and has a lubricant system, which introduces lubricant onto or into each zone where the edge deckle adjoins the roll sleeve. Preferably, the lubricant feed comprises at least one sensor (for example a pressure sensor, a flow sensor or a temperature sensor). Preferably, the data of at least one sensor is transferred wirelessly from a transmitter to a receiver within the suction roll.

Preferably, the lubricant feed comprises at least one actuator. Preferably, the control and/or regulating commands are transferred to at least one actuator wirelessly from a transmitter to a receiver within the suction roll.

The invention comprises elements of a suction roll selected from the group of elements comprising: sealing strip; sealing strip holder; edge deckle; suction box; engagement device; or lubricant system, wherein the element comprises at least one sensor and/or actuator which is in data communication with the receiver and/or transmitter, which is present within the space enclosed by the inner sleeve area of the roll sleeve.

The invention comprises elements of a suction roll selected from the group of elements comprising: sealing strip; sealing strip holder; edge deckle; suction box; engagement device; or lubricant system, wherein the element comprises at least one sensor and/or actuator and in addition a receiver and/or transmitter, wherein the receiver is configured to receive data of a transmitter arranged within the suction roll and the transmitter is configured to transmit data to a receiver arranged within the suction roll.

Preferably, the transmitter of the element is dimensioned, or its transmission power chosen, such that its signal does not reach, or is not reliably receivable at, the outside of the suction roll. This is the case, for example, when the type of signal is not suitable to penetrate the roll sleeve and/or lid, such as, for example, optical wireless signals. This is also the case, for example, when the transmission power is too low, for example with RFID transmitters.

Preferably, the signals of the transmitter arranged within the suction roll are shielded off against the environment by the roll sleeve and the roll lids. This, of course, only applies for those transmitters which are designated for wireless communication with a receiver arranged within the suction roll.

DETAILED DESCRIPTION

The embodiments shown in the figures merely show possible embodiments, while it should be noted at this point that the invention is not limited to the specifically shown variant embodiments thereof but that combinations of individual variant embodiments among one another and a combination of any embodiment with the general description given above are also possible. These further possible combinations do not need to be expressly mentioned, since these further possible combinations are within the knowledge of a skilled person active in the relevant technical field based on the teaching on technical procedure by the present invention.

Figure 1:
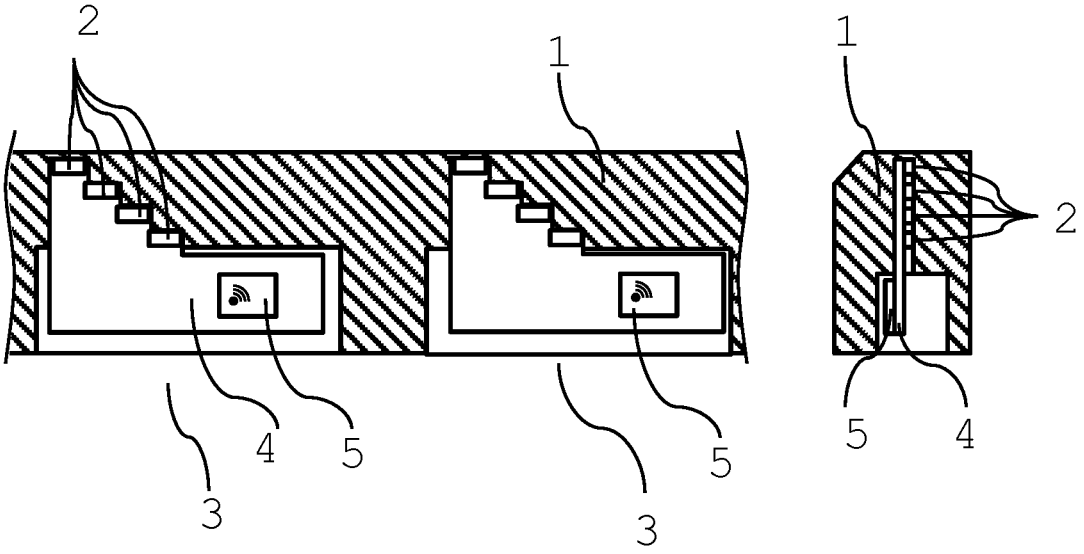
FIG. 1 shows the structure of an exemplary sealing strip having temperature sensors with wear detection.

In FIG. 1, the sealing strip 1 is shown with integrated temperature sensors 2. As known from the prior art, multiple sensor units 3 may be integrated in the sealing strip 1, with each sensor unit 3 having multiple temperature sensors 2. The temperature sensors 2 have different distances from the upper area, i.e. the friction area of the sealing strip 1. The sensor units 3 each comprise one printed circuit board 4, temperature sensors 2, and a microchip 5 with an integrated radio module.

It is known from the prior art to position externally to the suction roll a radio receiver, which receives the data from the sensor units 3. The disadvantage thereof is that the radio transfer is disturbed by the metallic roll sleeve.

It is proposed as an improvement according to the invention to position the radio receiver within the suction roll.

It is known from the prior art to provide the sensor unit 3 with a battery, so that no wiring is needed within the sealing strip 1. The disadvantage thereof is that the battery can run empty.

It is proposed as an improvement according to the invention to provide the sensor unit with a receiver for a wireless energy transfer and to provide in its vicinity a transmitter for wireless energy transfer. Preferably, the sensor unit may have an accumulator to ensure energy supply to the sensor unit 3 in case of energy transfer disruptions.

The sealing strip 1 comprises at least one sensor unit 3, and preferably the sealing strip 1 comprises multiple sensor units 3 in order to be able to measure the temperature at multiple points of the sealing strip 1.

Figure 2:
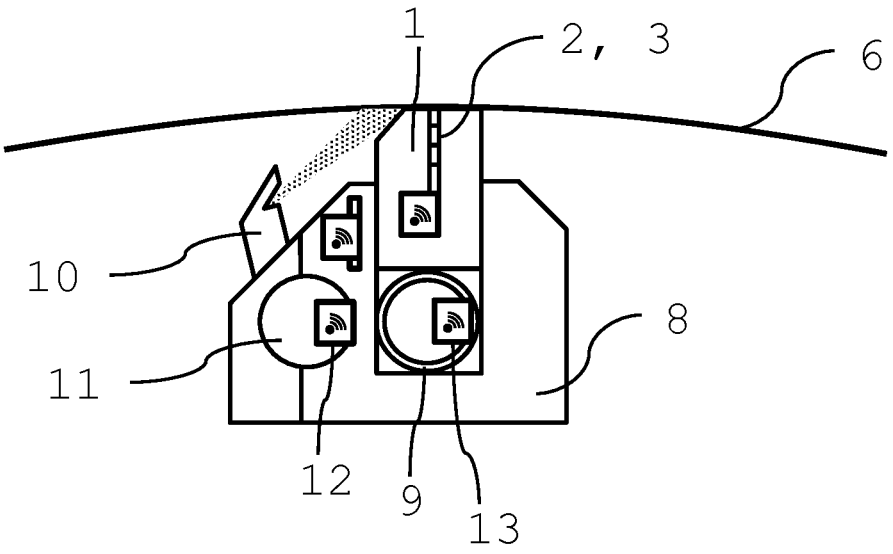
FIG. 2 schematically shows an exemplary sealing strip system.

FIG. 2 illustrates an exemplary sealing strip system, which is preferably the first sealing strip system of a suction box 7 to be employed in the movement direction of the roll sleeve 6. The sealing strip system consists of a sealing strip 1, which is movably accommodated in the groove of a sealing strip holder 8. An engagement element 9, formed, for example, as a pressure tube, is located below the sealing strip 1 in the groove. Upstream of the sealing strip 1, the sealing strip holder 8 is provided with a lubricant system, which has spray jets 10, via which the lubricant, in particular lubricating water, is introduced by a spray pipe 11, for example, integrated in the sealing strip holder 8. Preferably, a lubricant sensor 12, the measurement value of which reveals at least one parameter of the lubricant system, for example the flow amount or the pressure of the lubricant, is disposed at, on or in the lubricant system. Preferably, the lubricant sensor 12 has a radio module.

At least one sensor unit 3 is preferably integrated, or inserted, in the sealing strip 1. The engagement pressure used to press the sealing strip 1 against the inside of the roll sleeve 6 can be modified via the pressure in the pressure tube. Preferably, an engagement sensor 13 is disposed at, on or in the engagement element 9, the measurement value of which reveals the engagement pressure or force. Preferably, the engagement sensor 13 has a radio module. Preferably, at least one temperature sensor, which may serve to monitor the state of operation, is arranged on or in the pressure tube.

Figure 3:
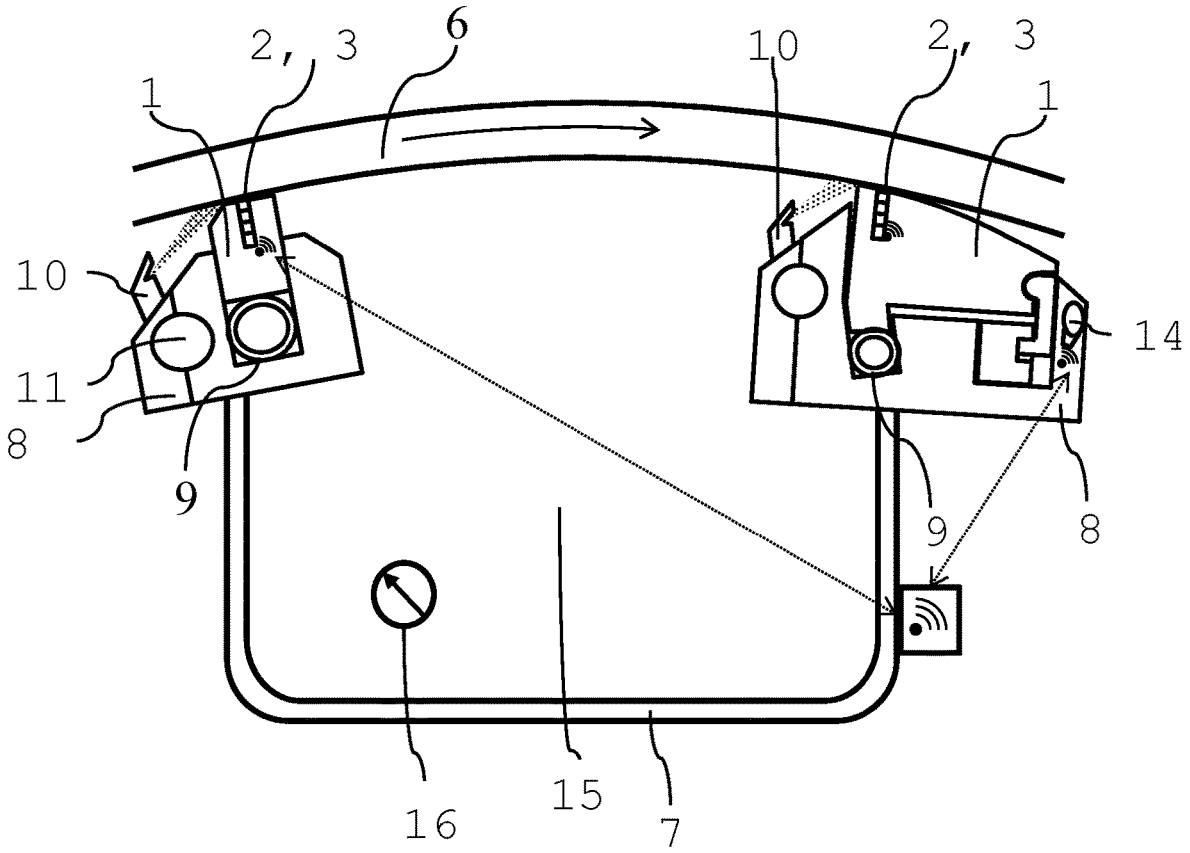
FIG. 3 schematically shows an exemplary sealing device of a suction roll.

FIG. 3 schematically shows the structure of a suction box 7 with two exemplary sealing strip systems. The movement direction of the roll sleeve 6 is indicated by an arrow. The first sealing strip system, which is in the front as seen in the movement direction, is executed according to FIG. 2.

In addition, FIG. 3 shows a second exemplary sealing strip system, which is preferably the second sealing strip system of a suction box 7 to be employed in the movement direction of the suction roll. The sealing strip system consists of a sealing strip 1, which has a crosspiece along the lower front edge, which is movably accommodated in the groove of a sealing strip holder 8. In the groove, an engagement element 9 is located below the crosspiece of the sealing strip 1. Upstream of the sealing strip 1, the sealing strip holder 8 is provided with a lubricating water system, which has spray jets 10, via which the lubricating water is introduced through a spray pipe 11. At least one sensor unit 3 is preferably integrated, or inserted, in the sealing strip 1. The engagement pressure, with which the sealing strip 1 is pressed against the inside of the roll sleeve 6 in the front zone, can be modified via the pressure in the engagement element 9. For example, the sealing strip 1 has a curved upper area, so that the upper area adjoins the roll sleeve in its front zone and forms a gradually increasing gap with the roll sleeve 6 in the rear zone. The width of the gap can be adjusted by a height-adjustable strip which can move the rear end of the sealing strip 1 closer to or away from the roll sleeve 6.

A sound sensor 14 or magnetic cartridge, depicted symbolically, which serves to measure the sound level at, or downstream of, the sealing strip, may be disposed at or in the sealing strip holder 8. Preferably, the sound sensor 14 has a radio module.

As can be seen from FIG. 3, the two sealing strip systems form the lateral delimitation of the suction box 7. The result is a zone 15 inside the suction box 7 that is sealed off from the rest of the interior of the suction roll.

As symbolically depicted, a pressure sensor 16 for measuring the negative pressure or vacuum in the sealed-off zone 15 may be located inside the suction box. Preferably, the pressure sensor 16 has a radio module.

Figure 4:
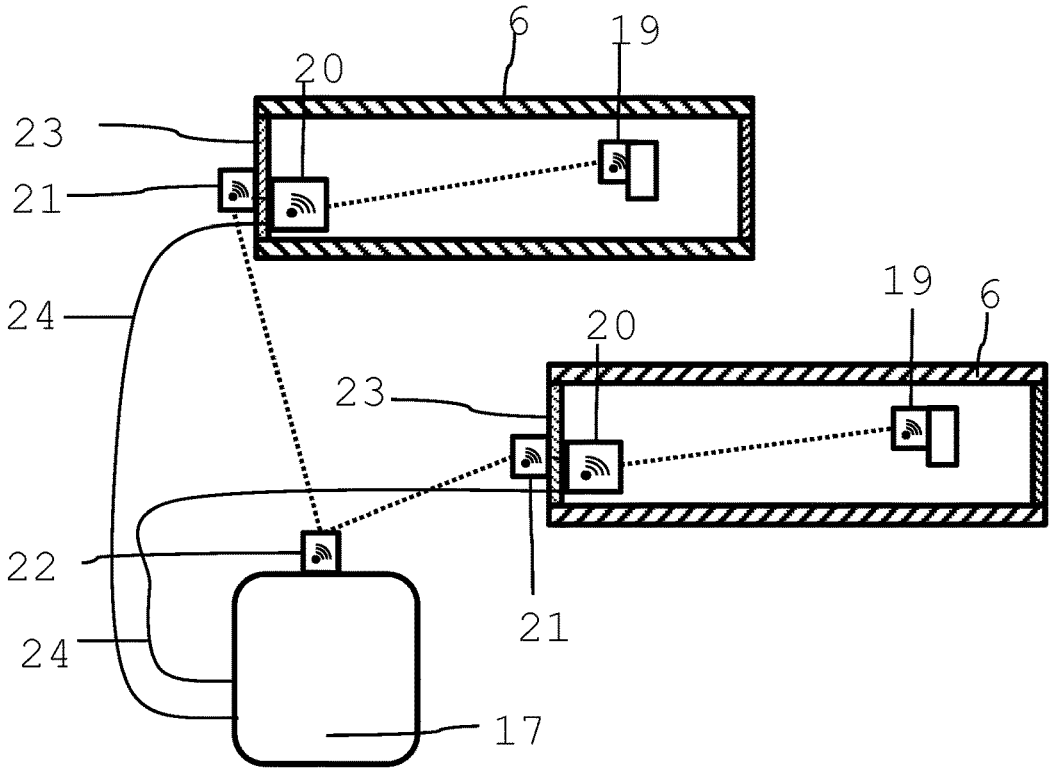
FIG. 4 schematically illustrates variant embodiments according to the invention.

In order to be able to monitor and/or control the suction roll, in particular multiple suction rolls, it is necessary to convey the needed data, for example the measurement values of sensors, out of the suction roll and to a control unit 17 external to the suction roll, which is illustrated in FIG. 4. For example, the control unit 17 determines from the measurement values the needed adjustment variables for controlling actuators of the suction roll. This may require conveying data from the control unit 17 into the suction roll.

Preferably, the control unit 17 is in, particularly wireless, data communication with display and input equipment in order to display the operating parameters and to allow manual modifications, for example with a screen, a tablet, or a smartphone.

The control unit 17 is preferably in data communication with multiple suction rolls. In addition, the control unit 17 may be in data communication with further system components of a papermaking machine, wherein the papermaking machine comprises at least one suction roll according to the invention.

In a variant embodiment, the suction roll has a receiver 20 on its inside. The receiver 20 may be at or on a lid 23 of the suction roll which closes an end of the roll sleeve 6. For example, the receiver 20 may be disposed at the end of a sealing strip holder 8. Preferably, the receiver 20 is disposed on the inside of the lid 23. In addition, the receiver 20 may have a transmitter, i.e. be present as a transceiver. The receiver 20 is in wireless data communication with a transmitter 19, which is also disposed inside the suction roll, spaced apart from the receiver 20. The transmitter 19 may have a receiver, i.e. be executed as a transceiver. The transmitter 19 is in data communication at least with a sensor or actuator, which preferably takes place via cables or traces.

The receiver 20 is in data communication with a control unit 17. This may be by the receiver 20 being cabled with the data processing system. In such a case, it is preferably provided that the receiver is connected to a bush on the outside of the lid, so that a cable 24 coming from the control unit 17 can be plugged on the lid 23.

In another variant embodiment, an outer transmitter 21, which can wirelessly communicate with the control unit 17 by the control unit 17 being in data communication with, or having, an outer receiver 22, is disposed on the outside of the lid 23. The outer transmitter 21 may preferably have a receiver, i.e. be executed as a transceiver. The outer receiver 33 may preferably have a transmitter, i.e. be executed as a transceiver. The outer transmitter 21 is in data communication with the receiver 20, which is arranged within the suction roll. There is preferably a data communication between the receiver 20 and the outer transmitter 21 through the lid 23, for example by cables or traces. In a variant embodiment, a wireless transfer may take place through an opening, in particular a bore, in the lid, for example, data may be transferred through the opening optically or by radio. A permeable inlet in the lid for wireless signal transfer, in particular for optical signals or radio signals, may also be present in place of the bore or opening. The lid itself is preferably made of metal, in particular steel. In this variant embodiment, at least one transmitter and/or receiver is present, which is arranged in or on the lid and which performs the task of transferring signals through the lid.

Preferably, it is provided that the control unit 17 has data communication with multiple suction rolls. A central control unit 17 preferably serves to monitor and/or control multiple suction rolls.

A variant embodiment involves controlling multiple suction rolls by a common control unit 17, which control unit 17 is in data communication with the receivers 20 of at least two suction rolls, which receivers are each arranged on the lid 23 of the suction roll or inside the respective suction roll, wherein the respective receiver is in wireless, contactless data communication with at least one transmitter, which transmitter is arranged within the respective suction roll.

Figure 5:
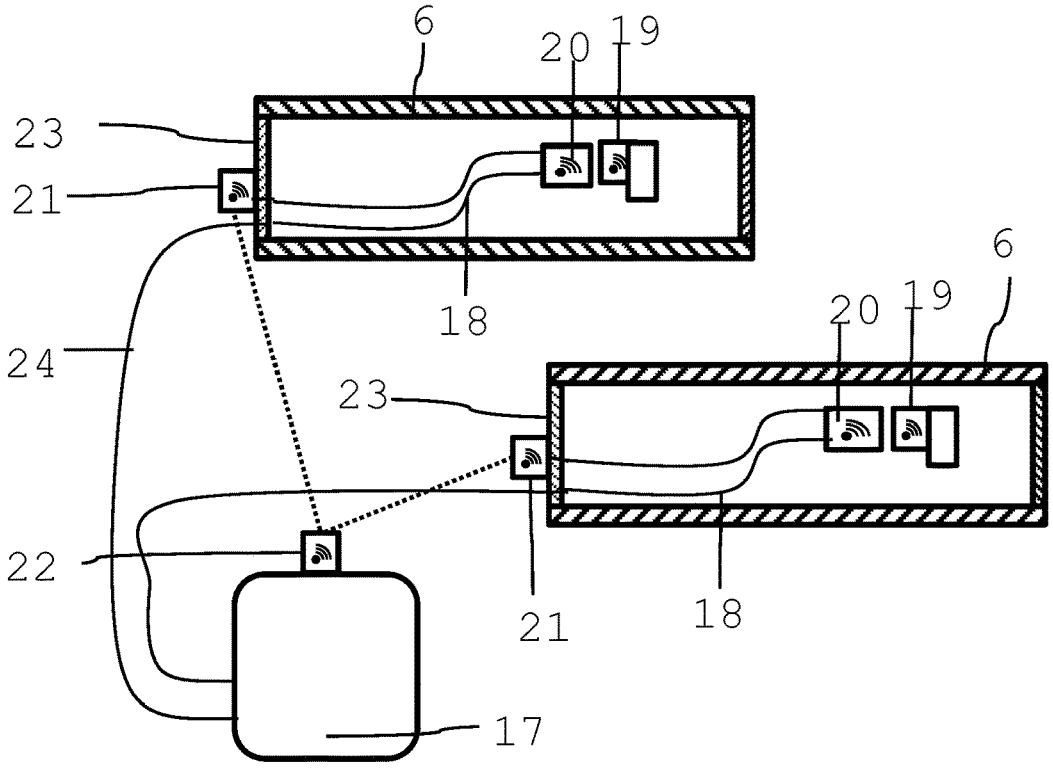
FIG. 5 schematically illustrates further variant embodiments according to the invention.

FIG. 5 shows a further variant embodiment, in which the transmitter 19 and the receiver 20 communicate with each other via near-field communication. The transmitter 19 and the receiver 20 may be executed as transceivers. Preferably, energy supply to the transmitter 19 is done in a contactless manner by the receiver 20. Preferably, energy is supplied to any sensors or actuators connected to the transmitter 19 in the same way.

The receiver 20 is in data communication with the control unit 17. The receiver 20 can have cabling 18 towards the lid or be in contactless data communication with a further receiver/transceiver on the lid via a further transmitter.

In a variant embodiment, a read head for reading a passive RFID tag is placed in the sealing strip holder 8 and a passive RFID tag, to which energy is supplied by the read head through inductive charging and via which data is read by the read head, is placed in the sealing strip 1.

A temperature sensor in particular may by disposed on the RFID tag.

In variant embodiments, a sensor for measuring sound or vibration, a pressure sensor, a dynamometric sensor and/or a moisture sensor may be disposed on the RFID tag.

A sensor for measuring deformation of the sealing strip holder 8, the sealing strip 1 or the suction box 7 may also be disposed on the RFID tag. Suitable sensors for measuring deformation include, for example, strain gauges, distance sensors, position sensors, laser position measurement, laser time-of-flight measurement, or light barriers.

A cable preferably runs from the read head in the sealing strip holder 8 to the front or one of the lids 23 of the suction roll.

The data may be wireless forwarded from the front or one of the lids 23 of the suction roll 23 to at least one data processing system or cloud, for example using GSM mobile communications, WLAN, radio, which applies to all variant embodiments, as does the following.

A data processing system, in particular a control unit 17, for example an PLC, a computer or a microcontroller, can obtain data directly by remote transfer or from the cloud, or can be connected to the front or a lid of the suction roll by cable.

Any device suitable for processing, displaying or storing sensor data may be considered as the data processing system. For example, the sensor data originating with the suction roll can be transferred to a storage external to the suction roll. For example, the sensor data originating with the suction roll can be processed or depicted with a digital subsystem such as an app or a web site.

In a variant embodiment, a control unit for the suction roll, which automatically determines or calculates instructions for the actuators within the suction roll, can also be present within the suction roll. The control unit can in this case depict a means or component or part of the means or components to transfer data from the suction roll (sensor data) and/or into the suction roll (instructions for the actuators). The data originating outside the suction roll can then be translated into instructions for the actuators by the control unit. The data originating with sensors within the suction roll can then be processed further and/or transferred further to the outside by the control unit. The wireless transfer between the transmitter and the receiver within the suction roll in this case takes place by way of transfer between the control unit and the sensors and/or actuators. The control unit is in, or can establish via wireless, wired or leaded transfer means, data communication with a data processing system external to the suction roll, a user equipment or a superior control unit 17 for multiple suction rolls.

The invention claimed is:

1. A suction roll comprising:

a roll sleeve;

at least one transmitter;

at least one receiver;

at least one of a sensor or an actuator; and at least one additional data transfer component which transfers data at least one of out of and into the suction roll;

wherein the at least one transmitter is located within a space that is enclosed by the roll sleeve;

wherein the receiver is located within the space that is enclosed by the roll sleeve;

wherein said transmitter is a first transceiver and said receiver is a second transceiver wirelessly communicating with each other, one of the first and second transceivers transfers data out of and into the suction roll via the additional data transfer component, and the other one of the first and second transceivers being in data communication with at least one of said sensor or actuator.

2. The suction roll as claimed in claim 1, wherein a contactless electrical energy transfer takes place from a first one of the transceivers which is in data communication with the additional data transfer component to the other one of the transceivers which is in data communication at least with a sensor or an actuator.

3. The suction roll as claimed in claim 2, wherein an electrical energy supply to at least one of the sensor and the actuator or to an energy storage associated therewith takes place by energy transferred in a contactless manner.

4. The suction roll as claimed in claim 3, wherein a first element transferring electrical energy in a contactless manner is arranged on or in a sealing strip holder of the suction roll and a second element receiving energy in a contactless manner, which supplies electrical energy to a sensor or actuator or to an energy storage, is arranged in a third element selected from: an element of a lubricating water system; an element of an engagement system; or a sealing strip.

5. The suction roll as claimed in claim 1, wherein a first one of the transceivers is arranged on or in a sealing strip holder of the suction roll and a second one of the transceivers, is arranged on or in an element of the suction roll selected from a group of elements comprising: an element of a lubricating water system; an element of an engagement system; the sealing strip holder itself; or a sealing strip.

6. The suction roll as claimed in claim 1 comprising an element that is located within the suction roll, the element is selected from a group of elements comprising: a sealing strip; a sealing strip holder; an edge deckle; a suction box; an engagement device; or a lubricant system, wherein the element comprises at least one of a sensor and an actuator which is in data communication with one of the transceivers.

* * * * *